US005103993A

United States Patent [19]

Bingisser

[11] Patent Number: 5,103,993

[45] Date of Patent: Apr. 14, 1992

[54] CONTAINER LID HAVING NON-PERPEDICULAR REINFORCEMENT RIBS

[75] Inventor: Josef E. Bingisser, Santa Ana, Calif.

[73] Assignee: Ropak Corporation, Fullerton, Calif.

[21] Appl. No.: 579,708

[22] Filed: Sep. 10, 1990

[51] Int. Cl.[5] ..... B65D 41/16

[52] U.S. Cl. ..... 220/306; 220/355; 220/356

[58] Field of Search ..... 220/306, 355, 356

[56] References Cited

U.S. PATENT DOCUMENTS

| | | | |
|---|---|---|---|
| 3,107,838 | 10/1963 | Brys et al. | 220/356 X |
| 3,532,244 | 10/1970 | Yates, Jr. | 220/306 X |
| 4,034,889 | 7/1977 | Hammes et al. | 220/306 |
| 4,256,240 | 3/1981 | Woinarski | 220/306 |
| 4,380,304 | 4/1983 | Anderson | 220/306 |
| 4,422,559 | 12/1983 | Landis | 220/306 |
| 4,457,447 | 7/1984 | Kirkis | 220/306 |
| 4,491,238 | 1/1985 | Tobolt | 220/307 |
| 4,512,493 | 4/1985 | VonHoldt | 220/306 |
| 4,518,097 | 5/1985 | Milton et al. | 220/307 |
| 4,711,364 | 12/1987 | Letica | 220/276 |

*Primary Examiner*—Stephen Marcus
*Assistant Examiner*—Vanessa Caretto
*Attorney, Agent, or Firm*—J. Mark Holland; Thomas P. Mahoney

[57] ABSTRACT

A container lid is characterized by a flange having reinforcing ribs with their axes disposed non-perpendicularly to said flange. The reinforcing ribs may be relatively thin in comparison to prior art devices and permit an increased flexibility of the flange, providing improved shock absorption capabilities and ease of installation and removal of the lid, and improved automation thereof.

7 Claims, 2 Drawing Sheets

CONTAINER LID HAVING NON-PERPEDICULAR REINFORCEMENT RIBS

BACKGROUND OF THE INVENTION

This invention relates to lids for containers, and specifically to a lid adapted to provide an increased degree of flexibility in operative flanges thereon, whereby the lid is less susceptible to inadvertent dislodgement from an associated container, and the ease of installation and removal of the lid with respect to such a container is improved without foregoing the necessary and desirable sealing and shape-retention properties of the lid and container.

To prevent undesired denting, bending, or other deformation, prior art lids sometimes include flanges with reinforcing ribs. These ribs typically render the flanges (and correspondingly the lid) relatively stiff and inflexible by virtue of the orientation of the reinforcing ribs perpendicularly to the flange, thereby preventing or resisting deflection of the flange in that direction.

The development or evolution of this prior art rib and flange configuration may find its roots in the utilization of injection molding processes and materials for forming such containers and lids. The desire for "stiffness" may have arisen from the need to market the injection-molded containers against metallic or other acceptably "tough" containers. The perpendicular reinforcement ribbing accomplishes the aforedescribed stiffening purpose, thereby persuading customers that the plastic containers may be suitably interchanged with and utilized instead of metallic or other containers. Additionally, the perpendicular orientation of the reinforcing ribs may permit easier removal of the lids from the forming molds, in comparison to more complex configurations.

Although the perpendicular ribs achieve the desirable stiffening of flanges, they also contribute to the undesired "popping off" of the lid when a container is inadvertently dropped or knocked over. Because the side of the container is typically not reinforced, it may be relatively flexible and may therefore deform when dropped (especially when filled with a heavy commodity). The relatively inflexible lid on the container (due at least in part to the perpendicular reinforcing ribs) prevents the lid from correspondingly deforming, resulting in dissociation of the lid from the container and the spillage of the contents thereof.

In addition, the lack of flexibility of such prior art reinforced flanges can increase the effort required to install and remove the lid from an associated container. Where, for example, such a flange forms one or more side walls of a groove or channel for receiving an interengaging edge of such a container, and where such desired interengagement requires or would be aided by temporary deflection of such flange or flanges, the energy required to seat the lid on the container can be considerable. Similar considerations apply to removal of the lid from the container.

Moreover, the inflexible nature of the prior art flanges is relatively exacting in automated lidding processes. Misalignment of the flange with respect to the opening of a corresponding container tends to result in breakage of the container or lid, or at least non-seating of the lid, when automated machinery attempt to seat the lid on the container.

OBJECTS AND ADVANTAGES OF THE INVENTION

It is, therefore, an object of my invention to provide a lid for a container which incorporates non-perpendicular or oblique reinforcement rib members for a flange thereupon, thereby permitting some flexure of such flanges. Such configuration maintains a requisite degree of stiffness for the flange but permits some energy-absorption in the event of droppage of a container closed by such a lid, reducing the likelihood that such lid will inadvertently and/or undesirably become dislodged from its associated container.

An additional object of my invention is the provision of a lid of the aforementioned character which includes a central cover portion having a flange depending therefrom, and a plurality of reinforcing ribs adjacent the flange and operatively attached to the flange and to the cover portion, in which the reinforcing ribs having their axes disposed obliquely or non-perpendicularly with respect to the flange.

Another object of my invention is the provision of a lid of the aforementioned character in which the reinforcing ribs are preferably of substantially right-triangular configuration.

Still another object of my invention is the provision of a lid of the aforementioned character which permits easier installation and removal of the lid from an associated container, relative to prior art lids. The non-perpendicularity of the ribs with respect to the flange permits the flange to deflect during such installation and removal, which can be especially beneficial in automated lidding processes.

The improved lid requires less precise alignment on the container's opening preparatory to seating the lid thereon, because the flange will "give" and tend to properly align itself with the container when seating force is applied to the lid. Less force is required for removal because the flange provides less resistance to the perpendicular deflection necessary for removal of the lid from the container.

Yet another object of my invention is the provision of a lid of the aforementioned character which includes a centrally disposed cover portion having an inverted generally U-shaped cover edge, the U-shaped edge forming a groove for receiving an upper edge of a side wall of the container, the lid further including a flange operatively disposed in the groove and reinforced by a plurality of rib members operatively attached to the flange and the groove and/or the cover portion, the rib members having their axes disposed non-perpendicularly with respect to the flange.

Other objects and advantages of the invention will be apparent from the following specification and the accompanying drawings, which are for the purpose of illustration only.

DESCRIPTION OF PREFERRED EMBODIMENT

Figure 3:
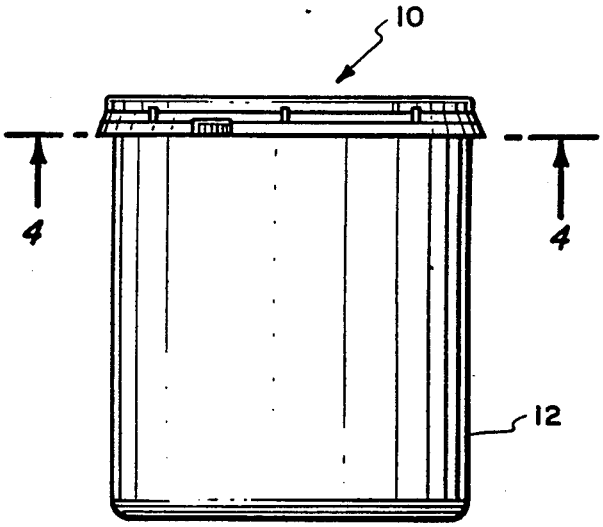
FIG. 3 is a side elevation view of a lid constructed in accordance with the teachings of the invention and mounted on an associated container.
Figure 4:
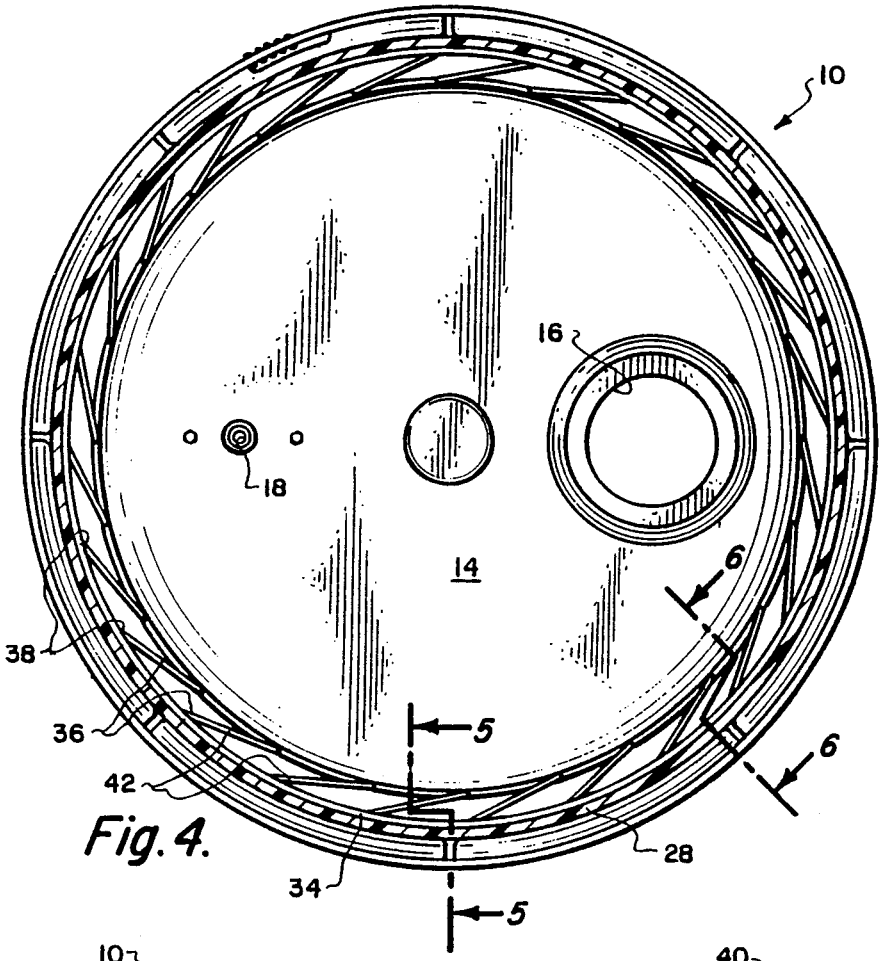
FIG. 4 is a partially sectional bottom view, taken along line 4—4 of FIG. 3.

Referring to the drawings, and particularly to FIGS. 3 and 4 thereof, I show a lid 10 constructed in accordance with the teachings of the invention and operatively seated on a container 12.

The lid 10 may be of any suitable size and shape so as to correspond to an associated container, but is illustrated in a circular configuration in the attached drawings. The lid 10 is preferably manufactured from injection-molded plastic, and preferably includes a substantially planar, centrally disposed cover portion 14. The lid 10 may be provided with an access port 16 and a buna "breathing" hole 18 to facilitate filling and/or removal of the contents from the container 12.

The lid 10 further preferably includes a ridge or an inverted generally U-shaped cover edge 20 formed by an inner wall member 22, an outer wall member 24, and an upper wall member 26. The underside of the ridge 20 forms a groove which is configured to receive an upper edge of a side wall 28 of the container 12. Retention means such as interengaging beads 30 and 32 are preferably provided on the side wall 28 and the cover edge 20, respectively, to accomplish the desired retention of the lid 10 on the container 12.

The lid 10 also includes a flange 34 preferably depending from the cover portion 14 near the perimeter thereof, disposed in the groove formed by the underside of the ridge 20, and adjacent the interior face of the upper edge of the container side wall 28. Those skilled in the art will understand, however, that the teachings of my invention are useful in a wide variety of alternative embodiments, including, by way of example but not by way of limitation, embodiments in which the flange 34 is attached directly to the central cover portion 14 and/or is not adjacent the container side wall 28 or is on the exterior side of such wall 28.

Figure 5:
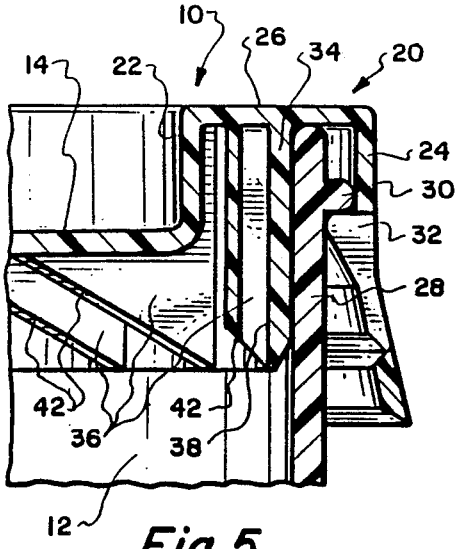
FIG. 5 is a partially sectional side elevation view, taken along line 5—5 of FIG. 4.
Figure 6:
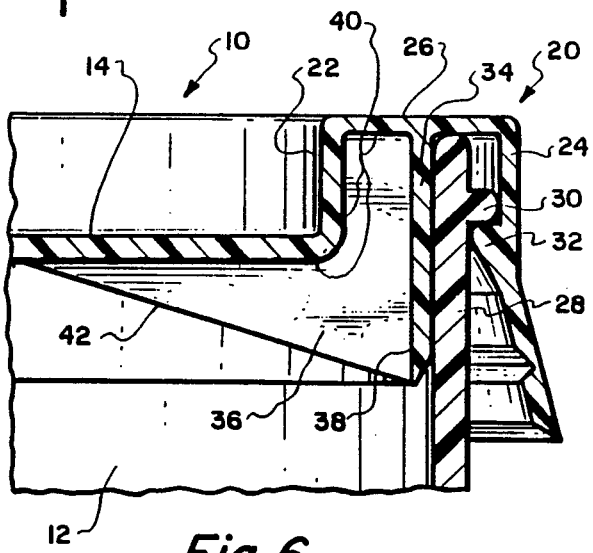
FIG. 6 is a partially sectional side elevation view, taken along line 6—6 of FIG. 4.

Operatively associated with the flange 34 is a plurality of reinforcing ribs or rib members 36, FIGS. 5-6. The ribs 36 are preferably operatively attached to the flange 34 across the width thereof, such as at a first edge 38 of the rib 36. The ribs 36 are also attached to the central cover portion 14, the inner wall member 22, and/or the upper wall member 26, such as along a second edge 40, FIG. 6. The preferred substantially right-triangular configuration of the ribs 34 is completed by a third edge 42.

In the preferred embodiment of my invention, the flange 34 and the ribs 36 are integrally formed with the remainder of the lid 10 during the aforementioned injection molding process.

As best illustrated in FIG. 4, the ribs 36 are configured so as to be oblique or non-perpendicular to the flange 34. This is in direct contrast to, and constitutes an important improvement over, ribs 44 of prior art lids, FIGS. 1-2.

In other words, the flange 34 defines a first plane, which may be curvilinear as illustrated in the attached FIGS. 4-6 or non-curvilinear as discussed elsewhere herein. Those skilled in the art will understand that, in constructions in which the ribs 36 are attached to curvilinear portions of the flange 34, each of the ribs is respectively disposed in a plane that is non-perpendicular to a plane that is tangent to the plane of the flange at the location of the attachment. For example, with respect to the cylindrical flange 34 illustrated in FIGS. 4-6, the ribs 36 are non-radially extending. Moreover, for non-curvilinear portions of the flange (such as described elsewhere in this specifications but not illustrated in the drawings), each of the ribs 36 is respectively disposed in a plane that is non-perpendicular to the plane of the flange at the location of the attachment.

Figure 1:
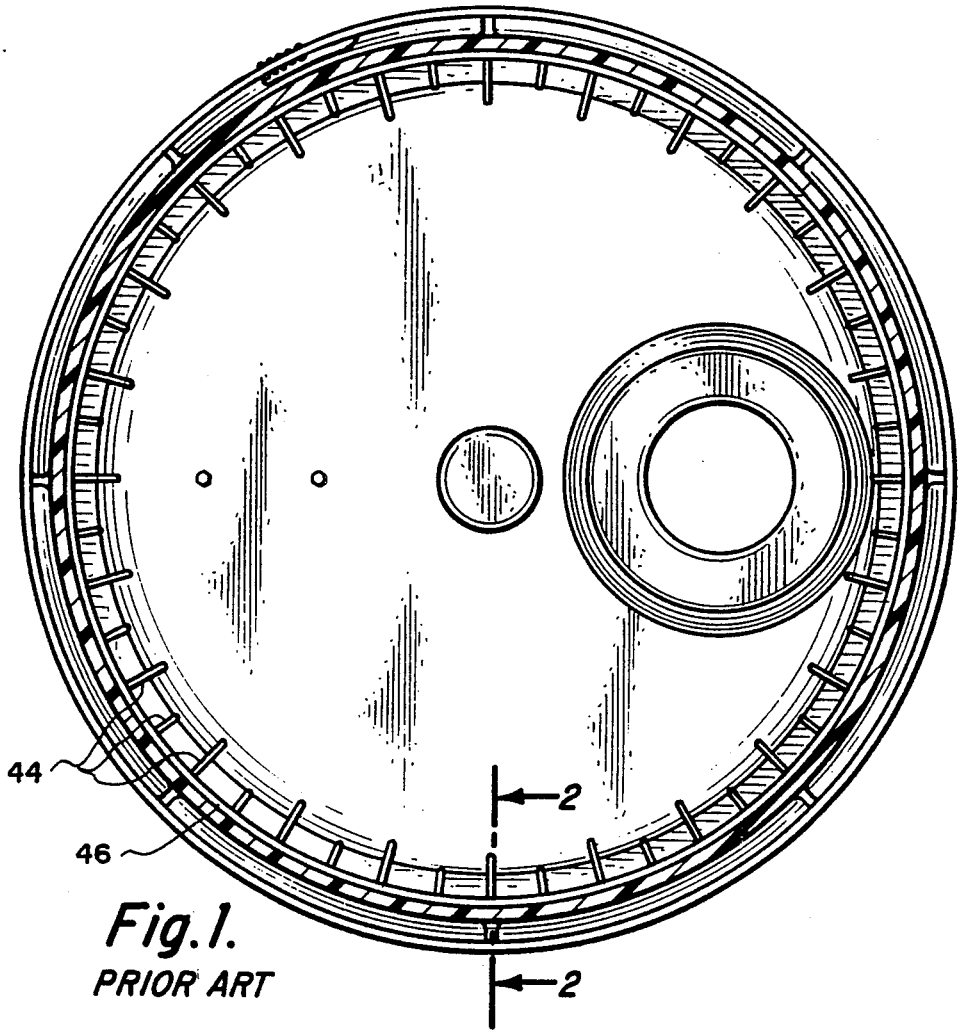
Fig. 1. PRIOR ART
FIG. 1 is a partially sectional bottom view of a prior art lid mounted on an associated container, as would be viewed along line 4—4 of FIG. 3 if FIG. 3 included a prior art lid.
Figure 2:
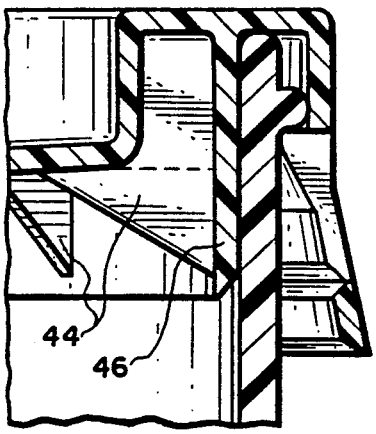
Fig. 2. PRIOR ART
FIG. 2 is a sectional side elevation view, taken along line 2—2 of FIG. 1.

As will be understood by those skilled in the art, the prior art reinforcing ribs 44, FIG. 1, prevent or at least significantly resist deflection or deformation of the flange 46 toward or away from the center of the lid. In order to flex the flange 46 along the axis of a rib 44, the rib would either have to buckle (to permit deflection of the flange toward the center of the container) or rip (to permit deflection of the flange away from the center of the container).

The reinforcing ribs 36, FIG. 4, of the present invention, in contrast, have their axes disposed non-perpendicularly with respect to said flange. This permits a degree of flexibility and ease of deflection of the flange 34 not achievable with prior art lids. In particular, the flange 34 may be flexed toward or away from the center of the lid without buckling or ripping the ribs 36.

To further improve the desired flexibility of the flange 34, the ribs 36 may be formed in a relatively thin structure, as compared to prior art ribbing. Depending on the particular plastic utilized, a preferred rib thickness is on the order of 0.030 to 0.040 inches to provide a useful degree of flexibility.

Additionally, although virtually any obliqueness or non-perpendicularity of the ribbing will provide some benefit with respect to flexibility of the flange 34, a preferred angularity is approximately 20 degrees between the flange 34 and each of the ribs 36.

Those skilled in the art will understand that the non-perpendicularity of the ribs 36 imparts an important and beneficial energy absorption capability to the lid which does not exist in prior art constructions. For example, and as indicated above, when prior art lids are assembled on containers and the assembly is accidentally dropped, or a stack of such containers is inadvertently knocked over during transportation or other processing, the prior art lid tends to "pop off" of the container as a result of the impact. The interengaging surfaces and/or flanges of the lid and container have relatively little capacity to flex and to thereby maintain their desired interengagement during such impact.

As explained hereinabove, the non-perpendicular ribbing of the instant invention permits such flexure and correspondingly enables an improvement in the capacity of the assembly to undergo such impacts without dissociation of the lid from the container.

As further indicated above, where the flanges and ribbing of my invention are utilized adjacent or as a component of the sealing or interengaging surfaces of the lid on the container, the lid is much easier to install and remove than are prior art lids because less energy is required to temporarily deflect the flange in order to engage or disengage the lid and the container.

Additionally and correspondingly, the performance of automated lidding processes may be improved by the non-perpendicular ribbing of my invention. When the machinery applies force to seat a somewhat misaligned prior art lid on a container, the non-deflecting flange becomes, in effect, an energy-storing lever arm. As seating force is applied, the container tends to deform (storing energy therein because of a plastic container's "shape memory" and tendency to return to it original shape). When sufficient deformation of the container occurs, the lid may be catapulted away from the container as the container returns to its original shape.

The instant invention, in contrast, tends to urge or permit a somewhat misaligned lid to seat itself properly on a container during automated lidding processes. Rather than acting as an energy-storing lever arm, the flange flexes and bends, which permits the contacting misaligned surfaces of the lid and the container to slide over one another into proper alignment, thereby avoiding the aforedescribed "catapulting" action.

Thus, by my invention I provide a container lid which permits a beneficial amount of flexure of a flange while retaining the necessary stiffness thereof, thereby decreasing the likelihood that the lid will be inadvertently dislodged from seating engagement with an associated container. Moreover, the aforedescribed flexibility reduces the effort required to install or remove the lid from the container, and improves the performance of certain automated lidding processes.

The lid of my invention has been described with some particularity but the specific designs and constructions disclosed are not to be taken as delimiting of the invention in that various obvious modifications will make themselves apparent to those of ordinary skill in the art, all of which will not depart from the essence of the invention and all such changes and modifications are intended to be encompassed within the appended claims.

I claim:

1. A lid for a container, including, a centrally disposed cover portion having a flange depending therefrom, said flange defining a first plane, and a plurality of reinforcing ribs adjacent said flange and operatively attached between said flange and said cover portion, said reinforcing ribs being disposed in one or more planes other than said plane; in which said operative attachment occurs at a location on said first plane at which said first plane is substantially flat or curvilinear; further in which, as to any of said ribs for which said operative attachment occurs at a location on said first plane at which said first plane is substantially flat, said one or more other planes are disposed non-perpendicularly with respect to said first plane; and further in which, as to any of said ribs for which said operative attachment occurs at a location on said first plane at which said first plane is curvilinear, said one or more other planes are each non-perpendicular with respect to a plane substantially tangent to said first plane at said location of said operative attachment.

2. The lid of claim 1, in which said reinforcing ribs are of substantially right-triangular configuration.

3. The lid of claim 1 or claim 2, in which said container includes an upper edge, and said flange is disposed perimetrically inwardly from and adjacent to said upper edge of said container.

4. The lid of claim 1 or claim 2, in which said flange is operatively disposed in an annular groove on said cover portion.

5. The lid of claim 4 in which portions of said reinforcing ribs are operatively disposed in said groove.

6. A container lid, including, a centrally disposed cover portion having an inverted generally U-shaped cover edge, said U-shaped edge forming a groove for receiving the upper edge of a side wall of a corresponding container, said lid further including a flange operatively disposed in said groove and reinforced by a plurality of rib members operatively attached to said flange and said groove and/or said cover portion, said flange defining a first curvilinear and/or non-curvilinear plane and said rib members being disposed in one or more planes other than said first plane, in which said respective one or more other planes for each of said rib members that is attached to said flange at non-curvilinear portions thereof is non-perpendicular with respect to said first plane at the location of said operative attachment, and in which said respective one or more other planes for each of said rib members that is attached to said flange at curvilinear portions thereof is non-perpendicular with respect to a plane tangent to said first plane at the location of said operative attachment.

7. The lid of claim 6 in which said rib members are of substantially right-triangular configuration.

* * * * *